United States Patent [19]

Langen et al.

[11] Patent Number: 4,650,415

[45] Date of Patent: Mar. 17, 1987

[54] COMBUSTION CHAMBER FOR HEATING DEVICES

[75] Inventors: Herbert Langen, Altbach; Erich Kenner, Esslingen, both of Fed. Rep. of Germany

[73] Assignee: J. Eberspächer, Fed. Rep. of Germany

[21] Appl. No.: 715,538

[22] Filed: Mar. 25, 1985

[30] Foreign Application Priority Data

Mar. 23, 1984 [DE] Fed. Rep. of Germany ..... 3410716

[51] Int. Cl.[4] ..... F23D 7/00; F23L 7/00

[52] U.S. Cl. ..... 431/115; 431/342; 431/263; 431/264; 431/340; 431/341; 126/77

[58] Field of Search ..... 431/260, 261, 262, 263, 431/264, 265, 266, 258, 330, 331, 333, 340, 341, 336, 337, 342, 116, 115; 126/77

[56] References Cited

U.S. PATENT DOCUMENTS

| | | | |
|---|---|---|---|
| 1,629,253 | 5/1927 | Breese | 431/115 X |
| 2,048,321 | 7/1936 | Carruthers et al. | 431/115 |
| 2,100,049 | 11/1937 | Bock | 431/336 X |
| 2,200,861 | 5/1940 | Peoples | 431/336 |
| 2,212,078 | 8/1940 | Sabin | 431/336 |
| 2,214,403 | 9/1940 | Chadwick et al. | 431/336 X |
| 2,339,637 | 1/1944 | Hayter | 431/336 |
| 2,358,012 | 9/1944 | Kahn | 431/336 |
| 2,379,018 | 6/1945 | McCollum | 431/263 X |
| 2,466,563 | 4/1949 | Stempel et al. | 431/337 |
| 2,492,756 | 12/1949 | McCollum | 431/263 X |
| 2,586,493 | 2/1952 | Ward | 431/260 |
| 2,769,411 | 11/1956 | Simmons | 431/115 X |
| 2,855,031 | 10/1958 | Miller | 431/116 |
| 2,966,942 | 1/1961 | Breese et al. | 431/262 X |
| 2,966,943 | 1/1961 | Breese | 431/339 |
| 3,134,423 | 5/1964 | Smith | 431/261 X |
| 4,421,474 | 12/1983 | Meyer | 431/115 |

FOREIGN PATENT DOCUMENTS

| | | | |
|---|---|---|---|
| 123708 | 3/1947 | Australia | 431/336 |
| 2507129 | 9/1976 | Fed. Rep. of Germany | 431/115 |
| 1219643 | 5/1960 | France | 431/341 |

*Primary Examiner*—Samuel Scott
*Assistant Examiner*—Carl D. Price
*Attorney, Agent, or Firm*—McGlew and Tuttle

[57] ABSTRACT

A combustion chamber for heating systems operated with liquid fuel can be used as vehicle heaters but also as heating systems for e.g. cooking purposes and whose control range is expanded as compared with known devices. The combustion chamber includes two sections separated from the combustion space by a plate with a passage opening. Depending on the purpose of use, a different flame guiding insert is arranged between the combustion space and the combustion chamber.

2 Claims, 4 Drawing Figures

COMBUSTION CHAMBER FOR HEATING DEVICES

FIELD AND BACKGROUND OF THE INVENTION

This invention relates in general to combustion devices and in particular to a new and useful combustion device for a heater or stove.

The invention relates to a combustion chamber for heating devices operated with liquid fuel, having a combustion space with a correlated first section in which the combustion air supply occurs tangentially, and a further second section, having a pipe with the ignition means, as well as a connection for a metering pump and for an area for spark plug ventilation.

Such combustion chambers are needed for heating devices which are used as household heating systems, e.g. at cooking stations and also for motor independent vehicle heaters. For household heating systems pressure atomizer burners with wattages starting at about 20 kW are known. Smaller wattages down to 12 kW are realized with expensive oil preheating, but substantially smaller wattages are not possible. But devices with relatively low output are required when what is involved is e.g. a single cooking station. In vehicle heaters the known devices can be regulated for burner outputs between "Full" ("High") and "Off", in some vehicle heaters between "Full" and about "one quarter burner output". A greater control range is not known at present, although it would be desirable for comfort and also so as to have to ignite only once in a heating interval, while in the known heating systems with thermostat control the control occurs by On/Off switching; this leads to increased current consumption from the vehicle battery and may lead to premature discharge of the battery, the more so as such heaters are operated preferably at standstill, that is, with the engine turned off.

In such heating devices the fuel supply occurs by means of a pulse-controlled metering pump. In this case it is possible by means of a frequency regulator, through a thermostat, to regulate the output of the heating equipment to a certain extent by varying the pump frequency, as for instance in a range of from 1:4 to about 1:8.

SUMMARY OF THE INVENTION

The invention provides a combustion chamber, by the construction and design of which its output range becomes variable, so that the control range of the heating equipment is substantially expanded. At the same time the combustion space is to be suitable for installation either with the axis vertical or with the axis horizontal.

The combustion chamber includes a first section separated from the combustion space by a plate having a central passage opening and which comprises a truncated cone-shaped portion with a cylindrical prolongation with the tapered part of the truncated cone-shaped portion pointing toward the combustion space and being provided with a pipe for tangential combustion air supply. A second section is pot-shaped and is connected at its open side with the first section and has a lateral pipe. The lateral pipe is designed to receive the spark plug ventilation line which extends from the first section to the lateral pipe of the second section. An internal diaphragm type insert is arranged in the region of the connection of the second section to the first section. With this design of the combustion chamber according to the invention an arrangement is indicated which permits an output regulation over the almost total output range. This results from the fact that both the flame form and the region in which the combustion takes place inside the combustion chamber can be varied. Thus it can be achieved that the combustion takes place only in the second section of the combustion chamber, or in both sections or in the entire combustion chamber and that thereby a controllability is obtained.

To keep the combustion in the second section and thereby to be able to run the smallest output stage, it has been found appropriate to give the diaphragm type insert a circular ring-shaped cross-section, the outer edge being bent by about 90° to form an abutment edge and the inner edge by about 90° in the opposite direction.

The exact angle measurements depend on the installation situation.

For the transition combustion from the second to the first section the diameter of the passage opening is of importance. Appropriately the ratio of the inner diameter to the outer diameter of the diaphragm type insert or disc is 1:1.2 to 1:4, preferably 1:2. To protect this diaphragm type insert against overheating, according to further aspect of the invention, there is arranged below the insert an anti-overheating disc which has a circular ring-shaped cross-section and is bent at its inner edge by about 90° to form an abutment flange. The anti-overheating disc is adapted to apply by its bent abutment flange against the bent inner edge of the diaphragm type insert, the disc being spaced from the insert and having a somewhat smaller outside diameter than the inner diameter of the second section.

For the form of the hot combustion gases or of the flame passing from the second section via the first section into the combustion chamber, the matching of the exit openings is essential. A further feature of the invention therefore is that the side of the plate toward the combustion space has a surface ascending from about the inner edge to a flange forming horizontal section at the outer edge. Thereby a flame form from dish-shaped to ray-shaped can be adjusted. Advantageously, the angle of inclination of the ascending surface is between 15° and 90°, preferably 20°.

For the connection of the combustion chamber wall and possibly also of a heat component it is appropriate to provide contiguous to the ascending surface of the plate on both sides a plane section, and according to a variant, the plate is formed in its plane inner section to receive a flame guiding insert. According to the invention, the ascending surface may be concave, this leading to an especially good contact of the combustion gases or of the flame. The further sub-claims indicate appropriate realizations of the flame guiding insert. This flame guiding insert contributes essentially to the flame form.

Accordingly it is an object of the invention to provide an improved combustion device which includes a plate having an opening which communicates with the top of a combustion housing having an upper portion with a tangential combustion air inlet and a lower portion for ignition of the burnable products which is connected with a lateral pipe containing a spark plug igniter and a fuel supply into the pipe along with a recirculating passage extending from the upper combustion passage back to the ignition and fuel supply plate which connects into the ignition portion of the combustion chamber.

A further object of the invention is to provide an improved device which may function as a heater or cooker.

A further object of the invention is to provide a combustion device which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
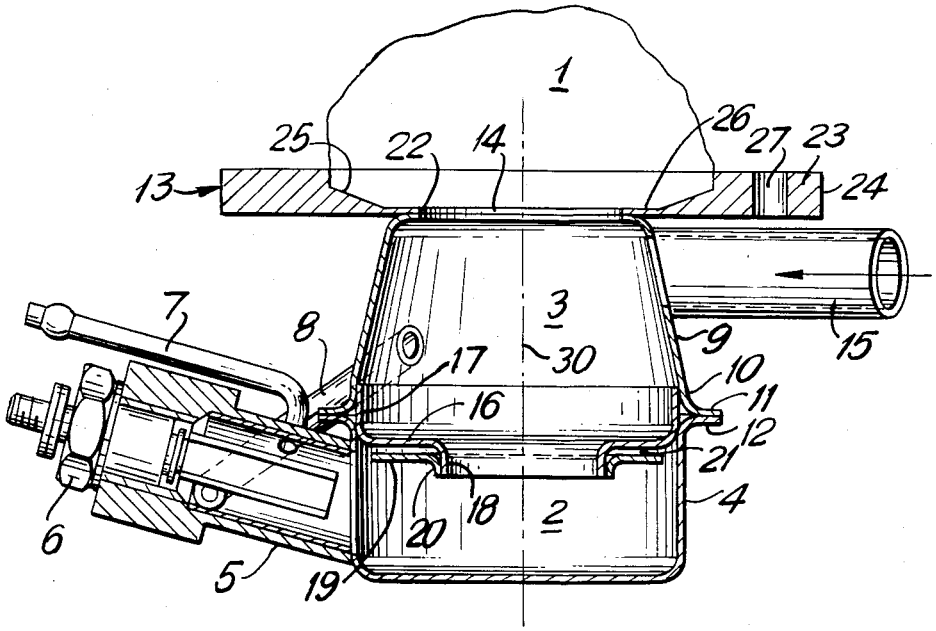
FIG. 1 is a sectional view of a combustion device constructed in accordance with the invention.
Figure 2:
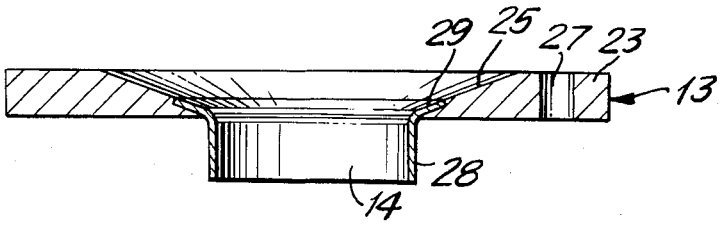
FIG. 2 is a sectional view similar to FIG. 1 showing a modified arrangement in accordance with another embodiment of the invention.
Figure 3:
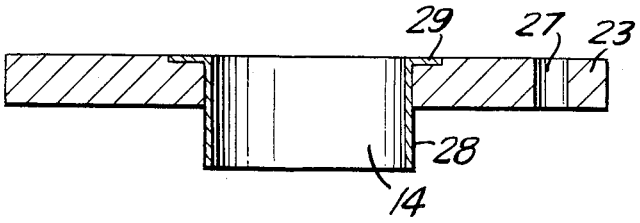
FIGS. 3 and 4 are views similar to FIG. 2 of still further embodiments of the invention.
Figure 4:
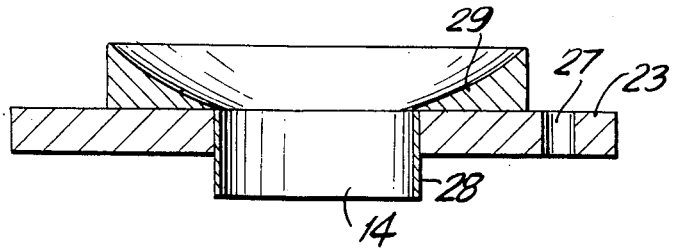

Referring to the drawings in particular the invention embodied therein comprises a heating device which includes a plate 13 having an opening providing a combustion area over the opening designated 1. A housing below the plate has a combustion products whirling upper portion 3 connected to the opening of the plate and a lower ignition combustion chamber 2 below the upper portion. A dividing wall is formed between the upper and lower portions of the combustion chambers 2 and 3 and has a central gas passage therebetween which is formed by their flanged interengagement.

Ignition means includes a spark plug 6 contained in the lateral pipe 5 which connects into the ignition and small combustion space 2. The liquid fuel is supplied through a fuel line 7 into the pipe 5. Combustion air which enters through an inlet 15 is whirled around in the combusion chamber space 3 and a portion of the gases are circulated back through a spark plug vent 8 which connects into the lateral pipe of around the spark plug 6.

In FIG. 1 is shown the combustion chamber consisting of a combustion space 1 with a first section 2 and a second section 3. Not shown is the combustion space wall as well as means for exhaust gas removal and the structural parts which are not part of the invention. In the embodiment the first section 2 of the combustion chamber is pot-shaped and comprises at its jacket, that is, at its cylindrical prolongation, a lateral pipe 5 for connection of the spark plug 6. The fuel is supplied into the pipe 5 via the connection 7. The fuel may be selectively diesel fuel or gasoline. The air required to initiate combustion is supplied via the spark plug ventilation 8. This ventilation occurs via a line between the lateral pipe 5 and the second section 3.

The second section 3 of the combustion chamber includes a truncated cone-shaped portion 9 followed by a cylindrical section 10 and is connected with the first section 2 by a flange union 11/12. Contiguous to the section of smaller diameter of part 9, toward the combustion space 1, is a plate 13 with a central passage opening 14. Tangentially to the second section 3 a combustion air supply pipe 15 is arranged. In the region of the connection of the first section 2 to the second section 3 a diaphragm type insert or disc 16 is arranged, which has an abutting edge 17 bent toward the combustion space 1 and an edge 18 bent in the opposite direction and which serves to keep the combustion in the first section 2. Spaced from this diaphragm type insert 16 an overheating protection disc 19 with an abutting flange 20 is arranged in such a way that this disc 19 applies by its flange 20 against the outside of the inner edge 18 of insert 16 and has an air slit 21 opposite the horizontal section of insert 16. The outside diameter of disc 19 does not abur on the cylindrical prolongation 4 of section 2. Thereby overheating protection is achieved.

On its side toward the combustion space 1, plate 13 has an oblique surface 25 ascending from about the inner edge 22 to a flange forming horizontal section 23 at the outer edge 24. The slanting surface 25 may be concave and furthermore, at the inner edge 22, a likewise plane surface 26 may be formed. It serves in particular for receiving a flame guiding insert 29 with integrally formed abutting flange 26. Depending on the desired flame form, the flame guiding insert 28 or 29 may be cylindrical, in the form of a hollow truncated cone or like a nozzle. Bores 27 in plate 13 serve for the connection of the combusion space wall or respectively of a heat jacket and the exhaust gas discharge elements.

The controllability of the combustion chamber results physically by a change of the air excess number, i.e. the air excess is changed. With the arrangement according to the invention this is possible at constant combustion air throughput. This results from the fact that the first section 2 of the combustion chamber is designed as an ignition and small combustion space and the second section 3 acts as whirl or twist generating antechamber with a swirl zone. The fuel is supplied via the ignition element 6 to the first section 2, namely via the laterally arranged pipe 5. The combustion air is supplied via the tangential combustion air inlet 15 arranged at the second section 3, and between the second section 3 and pipe 5 there exists as connection the spark plug ventilation 8, so that the air required for ignition and combustion is supplied.

In the interior of section 3, in a swirl zone 30, the combustion air entering the second section 3 tangentially forms eddys, against wall 9 of section 3 it forms an abutting boundary layer which constitutes a radiation protection, so that both cooling out and the formation of depositions of unburned particles is prevented. Via the spark plug ventilation 8 combustion air gets into the antechamber pipe 5, so that a combustion takes place. Additional air required for combustion in the first section 2 is sucked off the second section 3, so that at smallest output the combustion takes place in the first section 2. Thereby a heating also of the combustion air in the second section 3 occurs and due to the design according to the invention the hot combustion gas or hot air gets into the combustion space 1 and can be taken off at the limiting wall thereof for space or area heating, e.g. for the heating of a hotplate (cooling plate). Upon variation of the fuel quantity, the combustion advances ever farther into the second section 3 and finally takes place there, the flame being able to extend into the combustion space 1 in order thus to reach the maximum output.

By the configuration of the plate 13 and the matching of the outlet openings or respectively the geometry of the flame guiding insert 28 or 29, the shape of the flame or of the combustion gas emerging into combustion space 1 can be determined. Thus, in the case of a household heating system with cooking possibility a short construction with dish-shaped, flat, and hence area heating action is desired, whereas for use, e.g. as vehicle heating equipment a ray shaped admission is desired.

It is of advantage further that the arrangement according to the invention can be operated both with vertical and with horizontal axis. The regulation can be effected by varying the fuel quantity stepwise or slidingly, the fuel transport occurs through a known metering pump and hence is largely independent of viscosity. An additional regulation to smallest outputs is possible by reducing the combustion air quantity, so that in all a wide control range exists.

While specific embodiments of the invention have been shown and described in detail to illustrate the application of the principles of the invention, it will be understood that the invention may be embodied otherwise without departing from such principles.

What is claimed is:

1. A low capacity variable output heating device for vehicles and households comprising a plate having a central opening, means defining a combustion area on one side of said plate communicating with the opening, a housing on an opposite side of said plate having an upper end with a combustion product whirling upper portion connected to the opening of said plate, and a lower ignition combustion chamber portion below said upper portion, a dividing disc between said combustion products whirling upper portion and said lower ignition combustion chamber portion, said disc having a central gas passage therethrough between said upper and lower portions, ingition and fuel supply pipes extending laterally into said lower ignition combustion chamber portion, ignition means in said ignition supply pipe, a liquid fuel supply directed into said fuel supply pipe and igniting therein and said ignited fuel supply flowing into said lower ignition combustion chamber portion and into said combustion products whirling upper portion, a venting pipe extending from said combustion products whirling upper portion downwardly into said ignition supply pipe, and a combustion air inlet duct connected tangentially into said combustion products whirling upper portion near said plate, combustion gases being formed in said combustion products whirling upper portion exiting through the central opening of said plate and into said combustion area; said housing being formed of two pot-shaped members with one member being inverted in respect to the other, each of said members having flanges that abut each other, said disc dividing said portions having an outer diameter engaged against an inside of said members and an inner diameter defining said central gas passage; said disc including an inner diameter with an inner edge extending into said lower ignition combustion chamber portion, said disc having an outer abutting edge at said outer diameter extending into said combustion products whirling upper portion and over said abutting flanges of said pot-shaped members, said edges of said disc extending at about 90° to an axis of said disc which extends through said central gas passage, said opening of said plate being axially aligned with said axis of said central gas passage, and an overheating wall connected to said inner edge and extending radially outwardly thereof in said lower ignition combustion chamber portion, said wall being spaced from said disc and having a central opening through which said central gas passage of said disc passes, said wall having an outer diameter which is smaller than said outer diameter of said disc.

2. A device according to claim 1, wherein said pot-shaped member forming said upper chamber portion is in the form of a truncated cone having a smaller diameter at said central opening of said plate and a larger diameter at said disc.

* * * * *